US005082694A

United States Patent [19]

Chang et al.

[11] Patent Number: 5,082,694

[45] Date of Patent: Jan. 21, 1992

[54] METHOD FOR MANUFACTURING A VESSEL FOR STORING RADIOACTIVE WASTE

[75] Inventors: Yun S. Chang, Masan; Dong J. Kim, Busan, both of Rep. of Korea

[73] Assignee: Korea Heavy Industries & Construction Co., Ltd., Changwon, Rep. of Korea

[21] Appl. No.: 503,882

[22] Filed: Apr. 3, 1990

[30] Foreign Application Priority Data

Jan. 31, 1990 [KR] Rep. of Korea ..... 90-1055

[51] Int. Cl.[5] ..... B05D 7/22

[52] U.S. Cl. ..... 427/239; 250/506.1; 427/305; 427/405; 427/433

[58] Field of Search ..... 427/239, 305, 405, 433; 250/506.1

[56] References Cited

U.S. PATENT DOCUMENTS

| | | | |
|---|---|---|---|
| 3,978,803 | 9/1976 | Asano et al. | 427/239 |
| 4,284,660 | 8/1981 | Donaghy et al. | 427/239 |
| 4,935,943 | 6/1990 | Schweltzer et al. | 316/272 |

*Primary Examiner*—Janyce Bell

*Attorney, Agent, or Firm*—Merchant, Gould, Smith, Edell, Welter & Schmidt

[57] ABSTRACT

This invention relates to a method for manufacturing a vessel for storing radioactive waste, and to a method for manufacturing a vessel which withstands the heat generated by the radioactive waste without deforming and a method for manufacturing the vessel. A method for manufacturing a stainless steel vessel for radioactive waste according to the present invention comprises eliminating impurities on the surface of the stainless steel, stirring copper plating solution while filling the vessel therewith in order to keep the solution at a constant temperature, thereby precipitating the copper and plating the surface of the stainless steel vessel, and then filling the vessel with lead.

1 Claim, 3 Drawing Sheets

METHOD FOR MANUFACTURING A VESSEL FOR STORING RADIOACTIVE WASTE

BACKGROUND OF THE INVENTION

Field of Invention

This invention relates to a method for manufacturing a vessel for storing radioactive waste, and more particularly, to a method for manufacturing a vessel which withstands the heat generated by the radioactive waste without deforming utilizing a conventional vessel.

At nuclear power stations, the nuclear fuel which is used as an energy source is stored in a specific vessel after using so as to carry it to a storehouse for storing radioactive waste. The specific vessel is made of, for example, a non-corrosive stainless steel and the shape of such vessels differs depending upon the manufacturer. The conventional vessel for storing radioactive waste is substantially a triple walled vessel, in which lead (Pb) fills a center space formed between an innermost space and an outermost space in order to shield the environment which is exterior the vessel from radioactive waste contained in the innermost space.

A method for filling lead between the two spaces comprises filling the center space with molten lead and gradually solidifying the molten lead from the bottom of the vessel. At this time, unless the speed of the solidification of the lead is carefully controlled, countless air gaps form between the lead at the surface of the container wall and the walls of vessel containing the lead. If such air gaps are distributed over a wide area, the heat produced by the radioactive waste in the vessel cannot be dissipated effectively so that the temperature of the cooling water in the proximity of the gaps increases. The vessel may then distort or deform due to excessive heat forming in a localized area. Such deformation of the vessel may result in the leakage of radioactivity.

The formation of air gaps depends on the extent of the adhesion of the lead to the stainless steel walls of the vessel during the solidification of the lead. However, when adding molten lead to the vessel's center space i.e., between the innermost space and the outermost space, the desired adhesion of the lead to the stainless steel wall does not occur since an alloy of stainless steel and lead cannot be made.

In the prior art, in order to improve the extent of the adhesion between lead and stainless steel during the solidification of lead, a mixture of tin and lead (Sn-Pb) is plated on the surface of the stainless steel as a bonding material. Thus, after the surface of the stainless steel is cleaned, for example by iron particle blasting or by pickling with chemicals, zinc chloride is deposited on the surface of the stainless steel vessel as a flux and the surface thereof is then heated with a torch, and a tin-lead mixture is plated on the surface of the stainless steel vessel.

However, in the method described above, the melting point of zinc is 273° C., which is very low. Especially, the melting point of zinc deposited on the surface of the stainless steel vessel becomes lower since an alloy of zinc and lead is made when heating the surface of the stainless steel with the torch. For example, as illustrated in FIG. 2, the melting point of ZnPb is 190° C. Therefore, at the process of preheating the stainless steel vessel, for example, to approximately 300° C., just before filling lead, the Tin/Pb melts from the vessel wall.

Hence, the tin-lead mixture does not function very well as a bonding material when filling the vessel with lead.

It is an object of the present invention to provide a method for manufacturing a vessel for storing radioactive waste.

It is another object of the present invention to provide a method for filling a conventional triple walled stainless steel vessel for storing radioactive waste with lead, in which the center space stainless steel walls which contain the lead therebetween are plated with copper to enable adhesion of the lead to the surface of the stainless steel under processing temperature to thereby inhibit the formation of countless air gaps between the interface of the stainless steel walls and the lead within the center space.

SUMMARY OF THE INVENTION

A method for manufacturing a stainless steel vessel for storing radioactive waste according to the present invention comprises eliminating impurities on the surface of the stainless steel, stirring copper plating solution while filling the vessel therewith in order to keep the solution at a constant temperature, thereby precipitating the copper and plating the surface of the stainless steel vessel, and then filling the vessel with lead.

BRIEF DESCRIPTION OF THE DRAWINGS

For fuller understanding of the nature and objects of the invention, reference should be made to the following detailed description taken in conjunction with the accompanying drawings in which:

FIG. 1 illustrates a cross-section of a conventional stainless steel vessel for storing radioactive waste;

DETAILED DESCRIPTION OF THE INVENTION

Figure 1B:
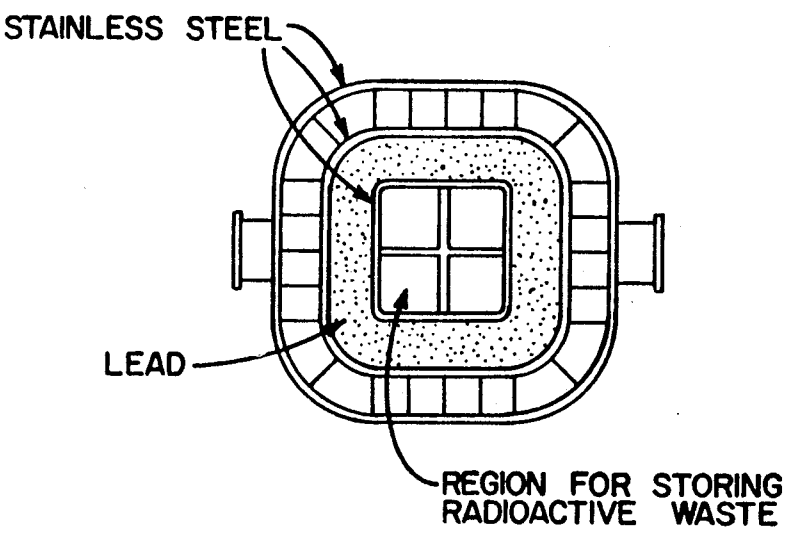
FIG. 1B illustrates a transversal cross-section of the stainless steel vessel.
Figure 1A:
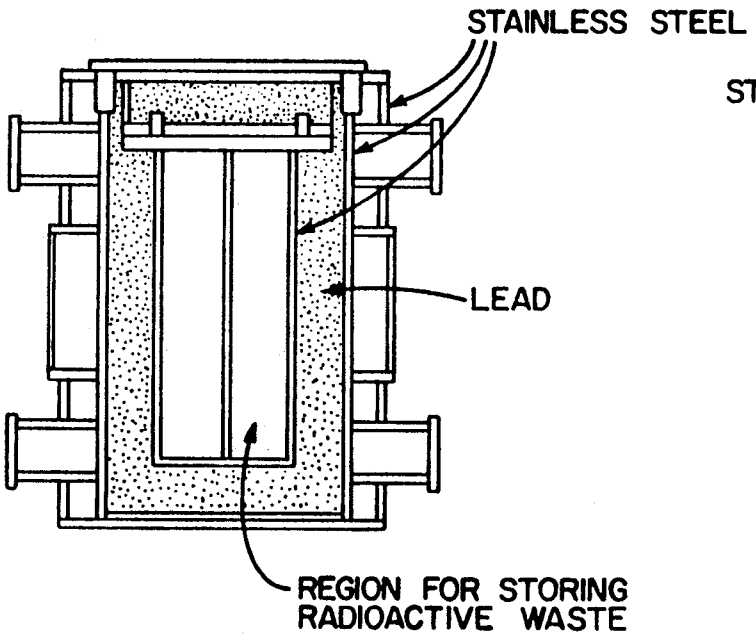
FIG. 1A illustrates a longitudinal cross-section of the stainless steel vessel.
Figure 2:
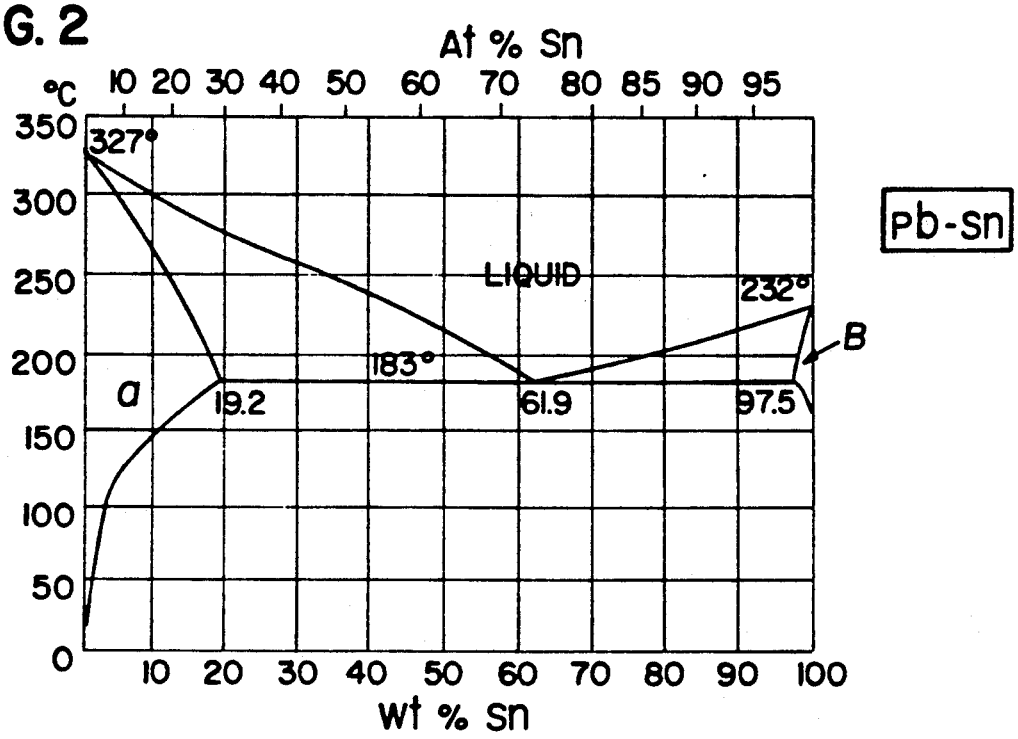
FIG. 2 illustrates a graph showing an equilibrium state of lead-tin.

The novel feature of the present invention may be understood from the accompanying description when taken in conjunction with the accompanying drawings.

The present invention relates to a method for plating the wall surface of a stainless steel vessel used to contain radioactive waste which will contain lead therebetween with copper in order to prevent the formation of countless air gaps between the interface of the stainless steel walls of the center space and the lead within the center space and provide a strong bond of lead and stainless steel at a high temperature, for example over 400° C.

According to the process of the present invention, in order to remove contaminants, for example, oil, grease, etc., the surface of the stainless steel is cleaned with a solvent and then cleaned with water. The surface of the stainless steel is then pickled with a mixed solution of sulfuric acid and hydrochloric acid. Preferably, the cleaning solvent is an alkaline solution and the concentration of sulfuric acid and hydrochloric acid of the solution used in the pickling process is 10% and 15%, respectively. The surface of the stainless steel of the vessel is then plated with copper. Thus, after pickling, a plating solution comprising copper sulphate, sodium hydroxide, formalin, etc., fills the stainless steel vessel and the solution is stirred while maintaining the temperature between 60° C. and 75° C. with quartz tube heater. Accordingly, the copper in the solution is precipitated, thereby plating the surface of the stainless steel.

As described above, the present invention utilizes an electrolysis copper precipitation plating method. Preferably, the thickness of plating on the surface of the stainless steel is 3 μm to 5 μm.

When the plating process according to the present invention is performed, preferably, the composition of the plating solution is prepared as follows:

450 g of rochelle salt, KNaC4H406.4H20, 110 g of sodium hydroxide, NaOH,50 g of sodium carbonate, Na2C03, and 0.0025 g of thiourea, (NH2)2CS, are dissolved in 1 liter of water, thereby obtaining a solution referred to as a first solution.

10 g of nickel chloride, NiC12.6H20, 70 g of copper sulphate, CuSO4.5H2O, and 250 ml of formalin, HCHO, are dissolved in 1 liter of water, thereby obtaining a solution referred to as a second solution.

Finally, the resulting plating solution, which can be used for plating according to the present invention, can be obtained by mixing the first solution, the second solution and water at a ratio of 1.3:1:12 in weight % , respectively.

It should be noted that after plating the stainless steel vessel with copper the copper coating will perform best if it is maintained in a clean and dry environment. That is, the vessel, and especially the cooper plated walls, must not be contaminated prior to molten lead fills the vessel.

Utilizing a dry conventional vessel which includes copper plated walls and before filling with lead, a plurality of electric heaters are arranged to apply heat onto the outer surface of the stainless steel vessel and the vessel is heated to a temperature of approximately 300° C. to 350° C. Then, molten lead of a temperature of approximately 300° C. to 350° C. is added to the vessel while the heaters which extend from the bottom portion to the top portion of the vessel maintain the top portion center space walls at a temperature of approximately 380° C. to 400° C. and maintain the temperature of the lower portion of approximately 350° C. to 400° C.

In order to uniformly solidify the molten lead in the stainless steel vessel, the space in which the radioactive waste is to be positioned is filled with pressurized air to cool the lead until the temperature of the lead reaches the solidification temperature. The positions of a plurality of electric heaters arranged on the outer surface of the stainless steel vessel should be changed to higher positions as the level of lead becomes higher, thereby exposing the surface of the stainless steel vessel to atmosphere for the natural cooling. Thus, it is possible to cool lead sequentially from the bottom to the top of the vessel.

At this time, in order to avoid the contraction of lead during the solidification and to remove the floating of oxides, a pressurized boiler is arranged and heats continuously the stainless steel vessel to the temperature, for example, 400° C. to 450° C. until the lead is fully solidified.

Figure 3:
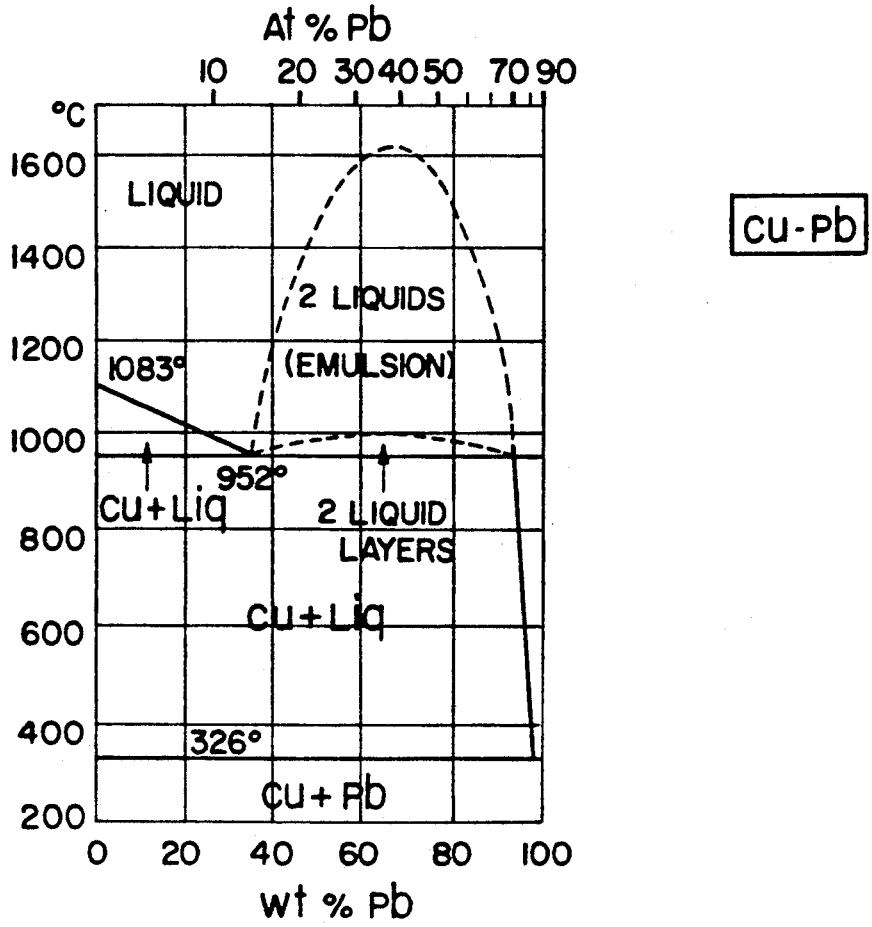
FIG. 3 illustrates a graph showing an equilibrium of lead-copper.

As described above, it is characterized in that the present invention utilizes the property by which lead and copper can easily make an alloy and such alloy has a good stability at high temperature as illustrated in FIG. 3, that is, the present invention utilizes the same phenomena as the copper film which is applied on a printed circuit board so that it can be soldered easily by lead.

Accordingly, the close adhesion between the stainless steel and lead can be obtained by the copper at high temperature over 400 C. In other words, the surface of the stainless steel can adhere closely to a copper film coating formed thereon by the copper plating and the molten lead can adhere closely to the copper coating film, thereby resulting in an indirect close adhesion without air gaps between lead and stainless steel through the copper coating film.

The method according to the present invention has been applied to a stainless steel vessel for storing radioactive waste, Model CASK, which was manufactured in 1988 at the Korean Energy Research Center's request. It was found that a stainless steel vessel for storing radioactive waste without air gaps between lead and the vessel had been obtained.

Figure 4:
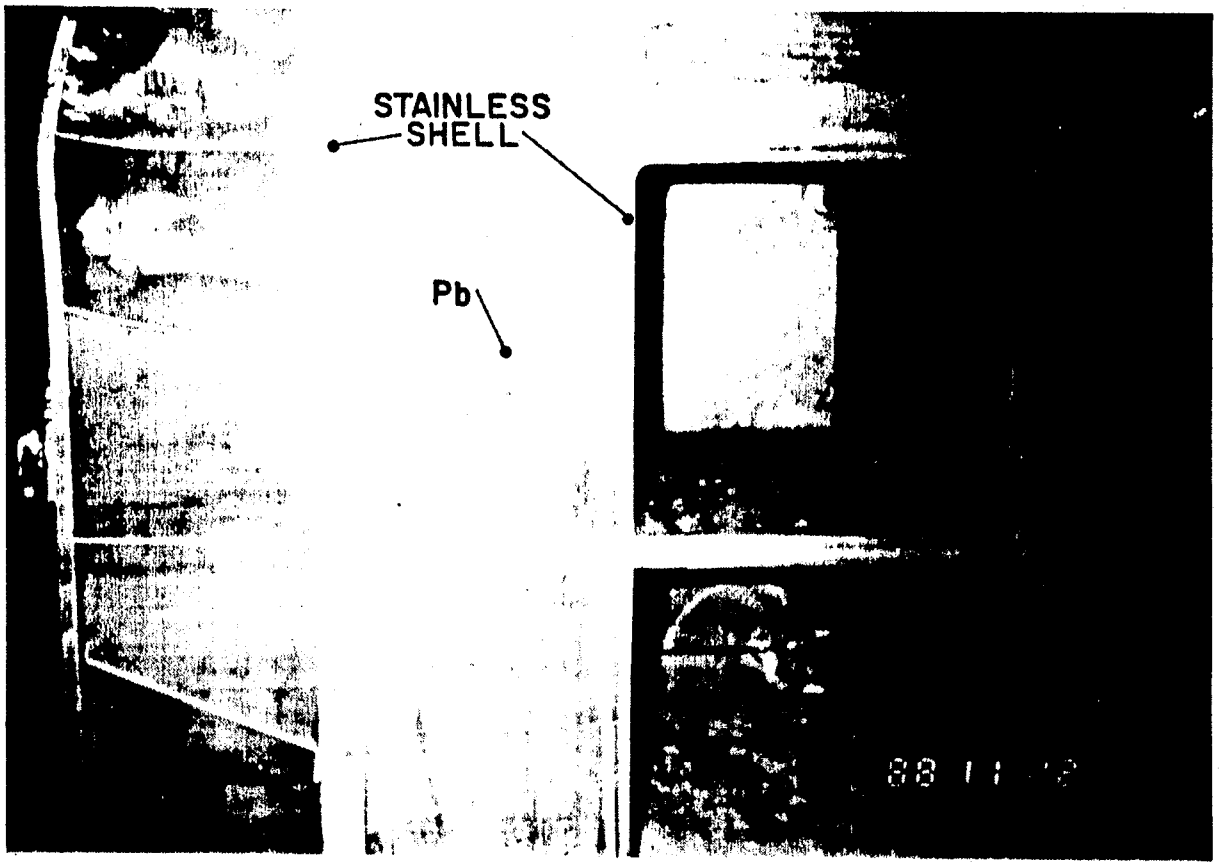
FIG. 4 illustrates a partial perspective view of a Model CASK in which lead is filled.

FIG. 4 illustrates a photograph of the cross-section of Model CASK which is attached hereto for reference.

As described above, the method according to the present invention can minimize incidence of air gap through a close adhesion which can be obtained by the copper plating on the surface of the stainless steel, thereby dissipating effectively the heat from the radioactive waste in the stainless steel vessel, and avoiding the distortion of the vessel due to an excessive local heating and the deformation due to the increase of pressure in the vessel. Therefore, the safety and reliability can be improved.

The foregoing description of the preferred embodiments has been presented for purpose of illustration and description. It is not intended to limit the scope of this invention. Many modifications and variations are possible in the light of the above teaching. It is intended that the scope of the invention be defined by the claims.

What is claimed is:

1. A method for manufacturing a stainless steel vessel for storing radioactive waste comprising the steps of:

providing a stainless steel vessel having walls forming an innermost chamber for receiving radioactive waste, an outer chamber generally surrounding the innermost chamber, and a center space located between the innermost chamber and the outer chamber, the center space comprising walls having an inner surface constructed and arranged for adhesion with lead material to be placed in the center space for shielding the radioactive waste;

removing contaminants from the inner surface of the stainless steel vessel center space walls;

filling a copper plating solution into the stainless steel vessel center space simultaneously with stirring the solution;

maintaining the solution at a predetermined temperature in order to precipitate the copper contained in the solution, thereby resulting in the copper plating onto the inner surface of the stainless steel vessel center space walls;

removing the copper plating solution from the stainless steel vessel center space; and filling the center space with molten lead and solidifying the lead.

* * * * *

UNITED STATES PATENT AND TRADEMARK OFFICE

CERTIFICATE OF CORRECTION

PATENT NO. : 5,082,694

DATED : January 21, 1992

INVENTOR(S) : Yun S. Chang, Dong J. Kim

It is certified that error appears in the above-identified patent and that said Letters Patent is hereby corrected as shown below:

Column 1, line 31; insert --the-- after the word "of".

Column 1, line 68; insert --it with-- after the word "filling".

Column 3, line 31; "cooper" should read as --copper--.

Column 3, line 32; insert --when the-- before the word "molten".

Column 4, line 8; "400 C" should read as --400° C--.

Signed and Sealed this

Sixth Day of July, 1993

Michael K. Kirk

*Attest:*

MICHAEL K. KIRK

*Attesting Officer*

*Acting Commissioner of Patents and Trademarks*